United States Patent [19]

Zodrow

[11] 4,079,875

[45] Mar. 21, 1978

[54] LABELING MACHINE STATION

[75] Inventor: Rudolf Zodrow, Dusseldorf, Germany

[73] Assignee: Jagenberg Werke AG, Dusseldorf, Germany

[21] Appl. No.: 625,727

[22] Filed: Oct. 24, 1975

[30] Foreign Application Priority Data

Nov. 2, 1974 Germany ..... 2451993

[51] Int. Cl.[2] ..... B65C 9/18

[52] U.S. Cl. ..... 225/96; 156/521; 156/568; 156/DIG. 33; 225/100; 271/275

[58] Field of Search ..... 156/567, 566, 568, 510, 156/516, 517, 520, 521, 540, 571, DIG. 33; 271/33, 36, 37, 95, 115, 117; 225/2, 94, 96, 96.5, 100

[56] References Cited

U.S. PATENT DOCUMENTS

| | | | |
|---|---|---|---|
| 3,159,521 | 12/1964 | Pechmann | 156/DIG. 33 |
| 3,404,059 | 10/1968 | Ritterhoff | 156/567 |
| 3,546,047 | 12/1970 | Dullinger | 156/568 |
| 3,553,049 | 1/1971 | Wolff | 156/517 |
| 3,567,559 | 3/1971 | Dullinger | 156/571 |
| 3,723,228 | 3/1973 | Schaltegger | 156/568 |
| 3,745,893 | 7/1973 | Helm | 156/521 |
| 3,767,515 | 10/1973 | Eden | 156/568 |
| 3,865,671 | 2/1975 | Kronsder | 156/521 |
| 3,871,943 | 3/1975 | Zodrow | 156/521 |
| 3,919,040 | 11/1975 | Zodrow | 156/571 |
| 3,923,589 | 12/1975 | Tavernier | 156/568 |

*Primary Examiner*—William A. Powell
*Assistant Examiner*—Michael W. Ball
*Attorney, Agent, or Firm*—Burgess, Dinklage & Sprung

[57] ABSTRACT

A labeling machine has a plurality of successive stations whereby a rotating pickup member on a revolving carrier picks up a label at one station, carries the label to a glue applicator station and transfers it to a gripping cylinder at another station. The invention provides a drum at the label supply station which rotates with the carrier and contacts the pickup member. A strip of labels passes about the drum into the nip between drum and pickup member and means, such as a steep helical thread and follower, are provided to speed up the pickup member so as to tear off the foremost label from the rest of the strip. Knives can be positioned inside the drum and cams and/or stops provided to project the knives out through slits in the drum so as to pre-score or perforate the label strip to facilitate tearing.

5 Claims, 4 Drawing Figures

LABELING MACHINE STATION

BACKGROUND

Figure 1:
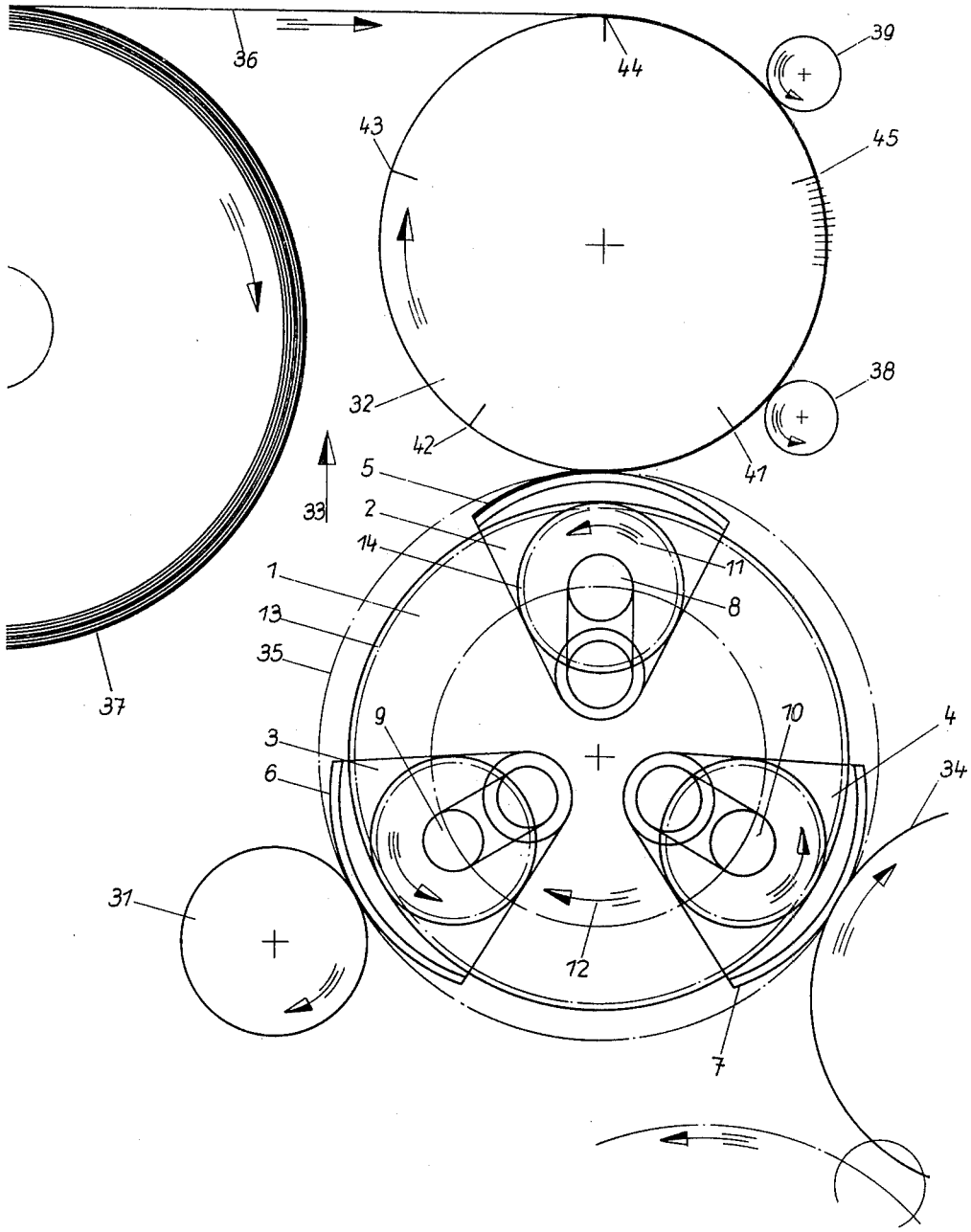

The invention relates to a labeling station in a labeling machine having a plurality of stations disposed successively in the direction of transport of the labels, namely a label supply station, a label transfer device, especially a gripper cylinder, and in some cases a rotating glue roll, and also having at least one pickup member rotatably mounted on a revolving carrier and carried past the stations upon each revolution of the carrier, the said pickup member having a convexly curved receiving surface rolling upon the foremost label at the label supply station and, in some cases, upon the other stations as well, and having, for its rotation about its own axis, a drive which varies the rotational speed of the pickup member to bring about the rolling of the receiving surface upon the foremost label and, in some cases, upon the other stations.

In one known labeling station of this kind, the labels are disposed in a stacked arrangement in a stationary label box, the foremost label being tangential to the outer rotational path of the pickup members. Disadvantages in such a labeling station are the need to prepare the stack of labels and to feed the labels through the label box; that is, the labels have to be cut along four edges and stacked with their edges flush. These stacks are placed in the label box and advanced as the labels are removed from them. If the edges are damaged or are not precisely flush, difficulty can be encountered in the removal of the labels from the label box by the pickup members.

Also, an apparatus is known for the application of pieces of foil to bottle necks and tops, in which the pieces of foil are pulled from a band of foil supplied in roll form. The band is pulled from the roll by a revolving drum over which the band is guided and which has knives in its interior which at least score the band for division into the desired pieces by being driven outwardly through a slit in the periphery of the drum in the area of its contact with the band. In the direction of advancement of the band, the drum is followed by a pair of rollers to which the band is delivered through guiding means. This pair of rollers revolves at a speed which is constant but greater than that of the drum, so that the foremost section of the foil is separated from the rest of the band at the scored line immediately after being gripped by this pair of rollers. The pieces then pass from this pair of rollers into the device which applies the pieces to the bottles. An apparatus of this kind, for tearing off pieces supplied in roll form, cannot easily be used in a labeling station, because in the labeling operation it is important that the individual labels be picked up by the pickup member in a very precisely determined position. In the case of the known apparatus, such a precise circumferential coordination of the pairs of rollers which separate the foremost section of foil from the band is not provided, since it is not needed for the application of the pieces of foil, which in this case are unprinted sheets which are wrapped about the neck or top of the bottle (German Pat. No. 1,225,102).

It is accordingly an object of the invention to provide a labeling machine of the type described and having means for reliably and precisely pulling labels off a roll.

THE INVENTION

This object is realized in accordance with the invention by providing a drum on a labeling machine which has a revolving carrier which carries a rotating pickup member. The drum revolves in the same direction as the carrier and its surface is tangential to the path of rotation of the pickup member. Rotation of the drum feeds to the pickup member a band of labels passing partially around it and to separate from the band the foremost label received by the pickup member, a drive accelerates the speed of rotation of the pickup member approximately upon the completion of its rolling movement.

In the labeling station of the invention, a pure rolling action takes place between the receiving surface of the pickup member and the circumferential surface of the drum on which the labels lie, so that the required precise peripheral coordination between the label and the curved receiving surface of the pickup member is assured. The pickup member, which is accelerated at the end of the rolling action, by itself produces the separation of the label which it has picked up from the band. The technical advance accomplished by this labeling station in comparison with labeling stations using labels supplied in boxes lies in the advantages associated with apparatus in which pieces are pulled from rolls, such as the ease of manufacture of labels ready for use, simplicity of resupply, and low susceptibility to disturbances of the label feed.

Although it is fundamentally possible to use label rolls in which weakening lines have been prepared between the individual labels, so that such weakening lines do not have to be produced as the material is being drawn from the rolls, the labeling station of the invention is suitable for the use of rolls which have not been prepared in this manner if a severing device is associated with the drum, which at least partially severs the individual labels of the band or strip in the portion thereof which is in contact with the drum. This severing device is advantageously a knife which is disposed within the drum and revolves therewith, and which, upon actuation by a stationary stop or by a cam, is moved radially outwardly through a gap in the circumference of the drum.

The drive which produces the acceleration of the pickup member upon completion of the action of rolling on the drum can be designed in various manners. In one embodiment it has a pinion meshing with a stationary sun gear and a compensating gearing coupled with the pinion and controlled by a cam follower following a stationary cam, the said compensating gearing consisting preferably of a steep spiral thread disposed between the pinion and the shaft of the pickup member, which makes possible an axial relative displacement between the pinion and the shaft under the control of the cam follower. According to a second embodiment, the drive has two cam followers which are guided in two stationary cams, are disposed at a fixed distance apart, and act rotatingly by means of lever arms upon the pickup member, the said two cam followers exercising, upon the rotation of the carrier, a torque in the same sense as the carrier, by virtue of the shape of the cams and the angular position of their lever arms.

Figure 2:
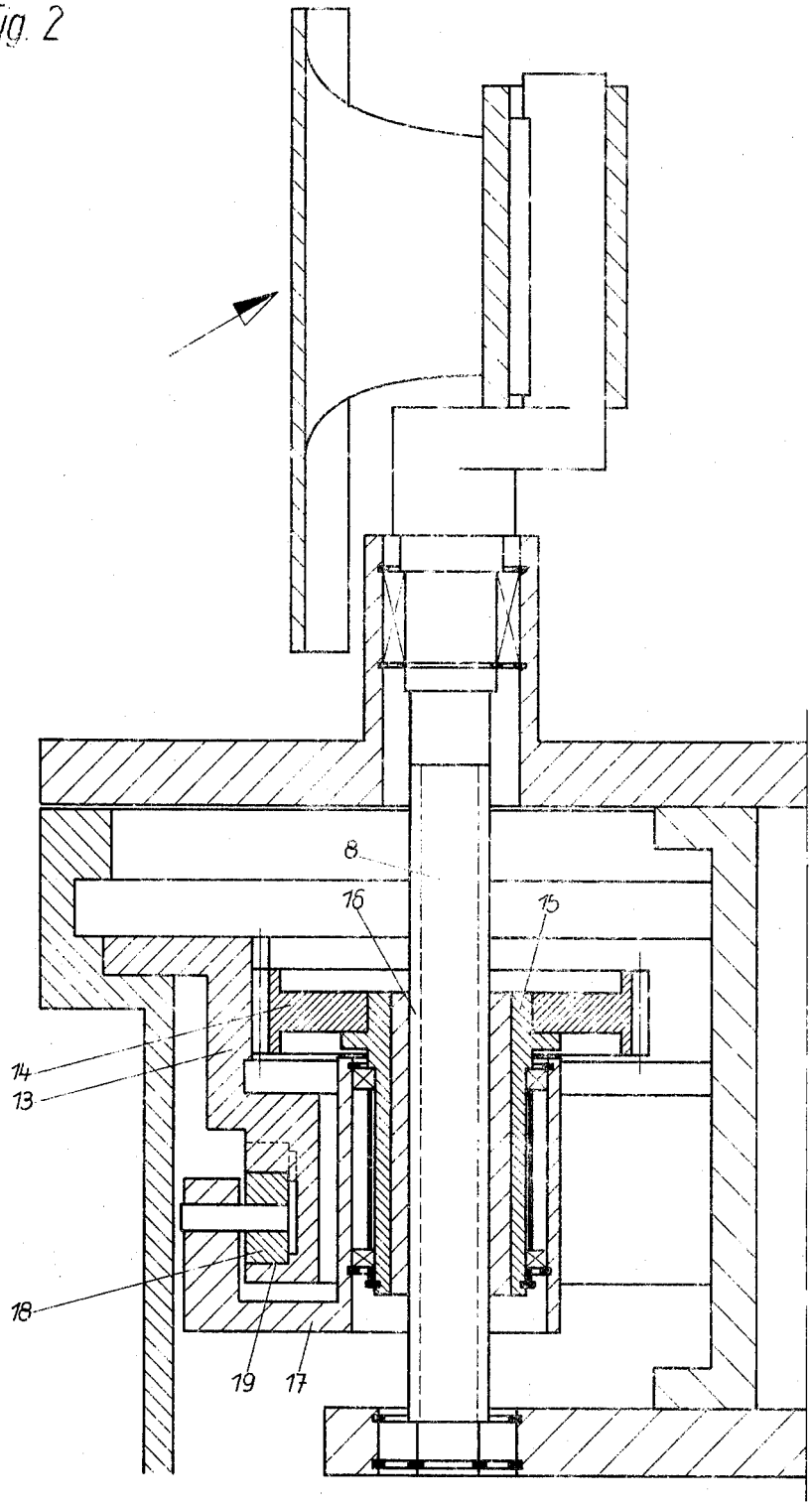
Figure 3:
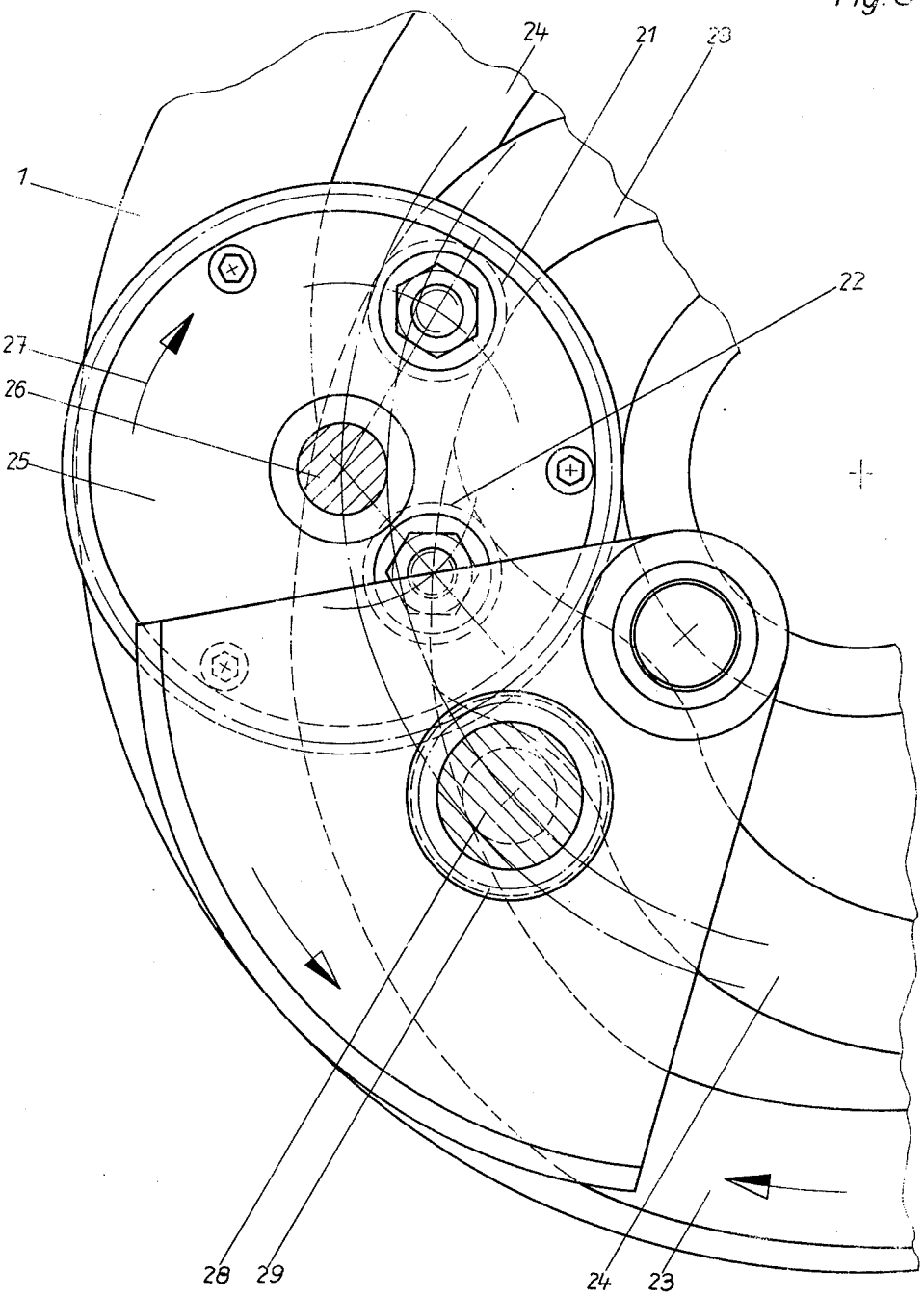
Figure 4:
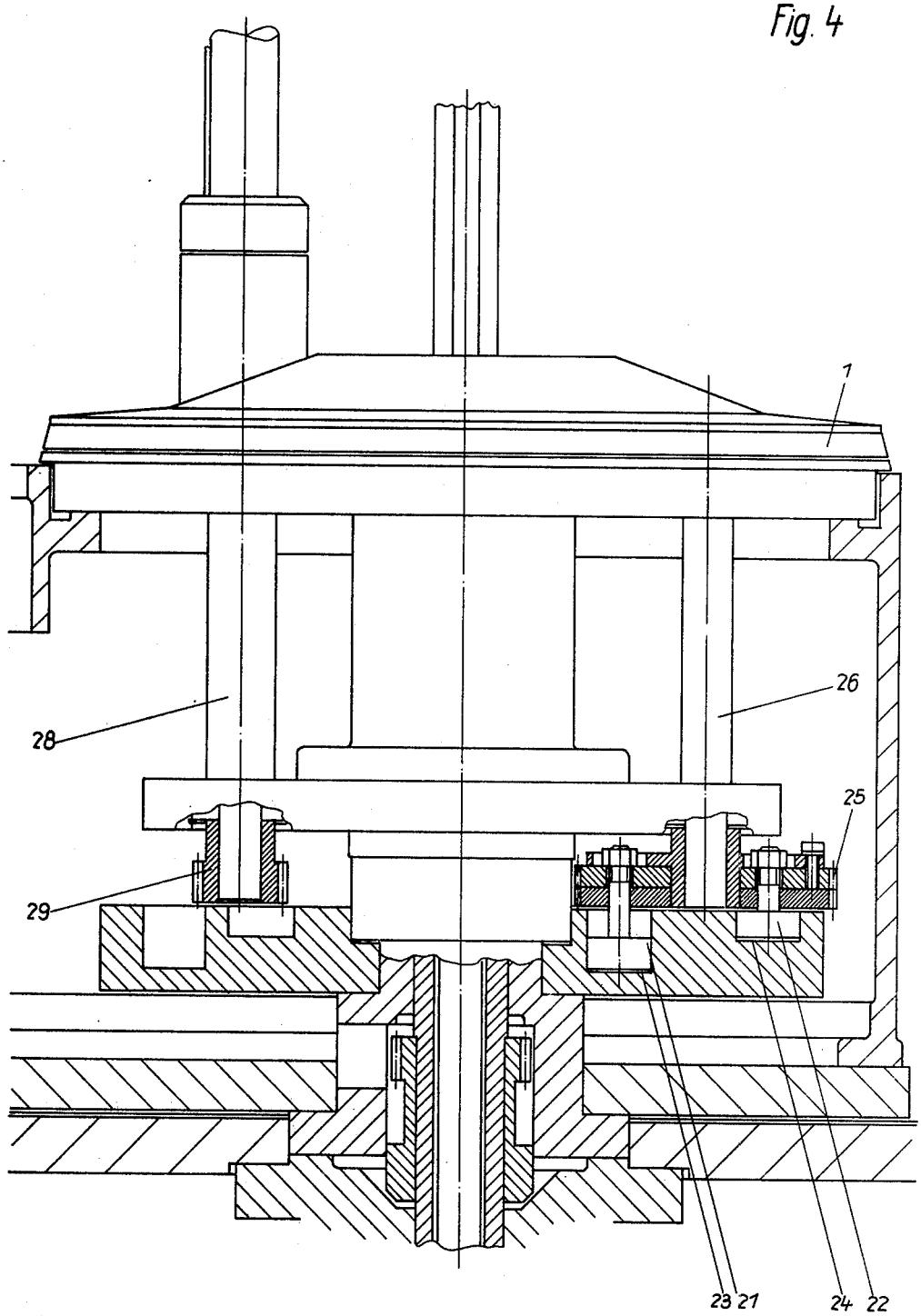

The invention will be explained hereinbelow with the aid of a drawing representing an embodiment thereof, wherein FIG. 1 is a diagrammatic top plan view of a labeling station, FIG. 2 is an axial cross section taken through the drive of a pickup member, FIG. 3 is a diagrammatic top plan view of a pickup member with its drive, and FIG. 4 is an axial cross section of the pickup member drive in accordance with FIG. 3.

The labeling station represented in FIG. 1 consists of a circular carrier 1 having three pickup members 2, 3 and 4 disposed on its upper side. The pickup members 2–4 have cylindrically curved receiving surfaces 5, 6 and 7. The segments 2–4 are driven by drive shafts 8, 9 and 10 in the direction of the arrow 11 and hence contrary to the direction of rotation indicated by arrow 12 for the carrier 1. The drive shafts 8–10 are rotatably mounted in the carrier 1 between the receiving surfaces 5–7 and their centers of curvature, and symmetrically with the receiving surfaces 5–7. In accordance with a first embodiment represented in cross section in FIG. 2, the drive has a stationary sun gear 13 which meshes with the pinion 14 on the end of each drive shaft 8. The pinion 14 is corotational with the drive shaft but axially displaceable thereon by means of a steep spiral thread 16 with the interposition of a bearing sleeve 15. The axial displacement of the pinion 14 is performed by means of an actuating member 17 which holds the bearing sleeve 15 and has a cam follower 18 in the form of a roller. The cam follower 18 engages a cam groove 19 provided on the outer circumference of the stationary sun gear 13. When the carrier 1 rotates, it carries with it the shaft 8 mounted in it, so that the pinion 14 meshing with the sun gear 13 drives the shaft 8. The pinion 14 is displaced axially on the shaft in accordance with the sinuosities of the cam groove 19. Since the coupling between pinion 14 and shaft 8 is in the form of a steep spiral, this axial displacement causes an additional rotatory movement to be superimposed upon the uniform rotatory movement produced by the rolling of pinion 14 on the sun gear 13, resulting in a non-uniform rotation of the shaft 8. The positions of the sinuosities of cam groove 19 are selected such that the receiving surfaces 5, 6 and 7 will roll upon the individual stations which are yet to be described.

In the second embodiment of the drive, in accordance with FIGS. 3 and 4, each actuator has two cam followers 21 and 22, which are guided in cam grooves 23 and 24. The cam followers 21 and 22 are disposed on a gear 25 rotating on shaft 26 mounted in carrier 1, such that they have lever arms of different length forming an obtuse angle with one another. The arrangement of the cam followers 21 and 22 and the sinuosities of the stationary cam grooves 23 and 24 are such that, upon the rotation of the carrier 1, the gear 25 will revolve in the same direction as carrier 1, as indicated by arrow 27. The gear 25 meshes with a gear 29 mounted corotationally upon shaft 28 of a pickup member. The construction and mounting of the pickup member are the same as in FIG. 2. The driving of the pickup member in the embodiment represented in FIGS. 3 and 4 is described in detail in application Ser. No. 597,277, filed July 18, 1975, in two variants. In this drive, too, the design of the cam grooves can be such that the rotatory movement of the pickup member, instead of being regular, will have the accelerations and retardations required by the folling movement to be performed at the individual stations.

In FIG. 1 it is shown that the individual stations are arrayed at intervals about the carrier 1 bearing the pickup members 2, 3 and 4, these stations consisting, one of a glue roller 31, another of a label supply station 33 having a drum 32 in addition to other parts, and the other of a gripper cylinder 34. The direction of rotation of the glue roller 31, the drum 32 and the gripper cylinder 34, as indicated by the arrows, is the same as the direction of rotation of the carrier 1, so that the basic requirement for the rolling of the receiving surfaces 5, 6 and 7 on the surfaces of the individual stations is fulfilled. In fulfillment of another requirement for the rolling action, the surfaces of the stations 31, 32 and 34 are tangential to the outer circle 35 commonly described by the three pickup members 2, 3 and 4. Since the rotatory movement of the pickup members 2, 3 and 4 is not uniform, but is cyclically accelerated and retarded, the assurance is provided that the receiving surfaces 5, 6 and 7 of the pickup members 2, 3 and 4 will roll without slippage on the surfaces of stations 31, 32 and 34. This is especially important when, as in the present embodiment, the glue roller 31 wets the receiving surfaces 5, 6 and 7 with glue, and the labels fed from the label supply station are to be applied smoothly to the receiving surfaces 5, 6 and 7.

The labels are supplied in the form of a continuous strip or band 36 wound in a roll 37. From this roll 37 they are pulled by the drum 32. To prevent the band from slipping on drum 32, rollers 38 and 39 press the band against the drum 32. The foremost label, pulled in this manner, and introduced into the nip between the drum 32 and the receiving surface 5 (or 6 or 7, as the case may be), is, as a result of the glue coating, picked up by the pickup member 2 on its receiving surface 5, while the said receiving surface 5 is rolling without slippage on the circumference of the drum. Upon completion of this rolling action, the pickup member is accelerated such that its peripheral speed becomes greater than that of the drum 32, so that the foremost label is torn from the label strip. To facilitate this separation from the label strip, a line of perforations is either provided in the band between the individual labels beforehand, or produced in the strip by the drum 32. In the embodiment represented in FIG. 1, it is indicated that knives 41, 42, 43, 44 and 45 are provided in the interior of the drum 32, arranged at equal intervals along its circumference. Upon the rotation of the drum, these knives accompany it and are pushed, by means of an actuating mechanism, through a gap in the wall of the drum into the label strip in the area between the rolls 38 and 39. A cylinder provided with knives in this manner is known from German Pat. No. 1,225,102.

It will be appreciated that the instant specification and examples are set forth by way of illustration and not limitation, and that various modifications and changes may be made without departing from the spirit and scope of the present invention. What is claimed is:

1. In a labeling machine having a label supply station and a label transfer station arranged successively in the direction of transport of the labels, a revolving carrier, a shaft driving said carrier, at least one pickup member rotatably mounted on the revolving carrier and moved past the stations upon each revolution of the carrier, the pickup member having a convexly curved receiving surface rolling upon the foremost label in the label supply station and having a drive which varies the rotational speed of the pickup member more or less than that of the carrier for rolling of the receiving surface upon the foremost label, the improvement which comprises a drum at the label supply station having a surface tangential to the path of rotation of the pickup member, means for rotating said drum in the same direction as the carrier, a strip of labels passing partially around said drum and fed thereby to the pickup member, and means for accelerating the speed of rotation of the pickup member approximately upon completion of the rolling movement over the foremost label, whereby said foremost label is separated from the strip received by the pickup member.

2. A labeling machine according to claim 1, including severing means cooperating with the drum so as to sever at least partially from one another the individual labels of the strip in the area wrapped around the drum.

3. A labeling machine according to claim 2, wherein the severing means includes a knife disposed in the interior of the drum and means positioned to displace said knife radially outwardly through a gap in the drum periphery.

4. A labeling machine according to claim 3, wherein said knife displacing means includes a stationary stop.

5. A labeling machine according to claim 1, including two stationary cams disposed at a predetermined distance from one another, the drive including two cam followers respectively cooperating with the stationary cams, the cam followers each having a pair of lever arms forming an angle with one another, said arms acting rotatively upon the pickup member, whereby when the carrier rotates the cam followers exert a torque of equal sense upon the pickup member by virtue of the cam pattern and the angular position of the lever arms.

* * * * *